United States Patent [19]

Gurth

[11] 4,335,994

[45] Jun. 22, 1982

[54] METHOD AND APPARATUS FOR PUMPING LARGE SOLID ARTICLES

[76] Inventor: Max I. Gurth, 1937 Dehesa Rd., El Cajon, Calif. 92020

[21] Appl. No.: 166,185

[22] Filed: Jul. 7, 1980

Related U.S. Application Data

[63] Continuation of Ser. No. 938,223, Aug. 30, 1978, abandoned.

[51] Int. Cl.[3] ..... F01D 1/36; B65G 53/30

[52] U.S. Cl. ..... 415/90; 415/213 A; 406/99

[58] Field of Search ..... 415/90, DIG. 4, 213 A, 415/213 R; 416/4; 406/99, 101

[56] References Cited

U.S. PATENT DOCUMENTS

| | | | |
|---|---|---|---|
| 1,061,142 | 5/1913 | Tesla | 415/90 |
| 2,635,548 | 4/1953 | Brawley | 415/213 A |
| 3,045,428 | 6/1962 | McLean | 415/90 |

FOREIGN PATENT DOCUMENTS

| | | | |
|---|---|---|---|
| 2592 | 6/1979 | European Pat. Off. | 406/99 |
| 2292882 | 6/1976 | France | 415/206 |
| 1461776 | 1/1977 | United Kingdom | 415/90 |

OTHER PUBLICATIONS

O'Keefe, W., "New Efforts Aim At Practical Application Of Multiple-Disk-Pump Concept In Industry", Power, Dec. 1975 pp.51-53.

*Primary Examiner*—Leonard E. Smith
*Attorney, Agent, or Firm*—Brown & Martin

[57] ABSTRACT

A pump for pumping large solid articles includes a rotary pump having a plain disc impeller disposed in a substantially cylindrical chamber of a housing with an inlet coaxial of the impeller into the housing and an outlet from the periphery of the chamber with a rotor arranged to provide a substantially unobstructed passage between the inlet past the discs of the rotor to the outlet of the pump. The impeller includes pairs of discs spaced close together for providing increased fluid pressure and pairs spaced apart a distance for providing a passage for the solid articles. The articles are pumped in a fluid medium, such as water, through the pump and maintained suspended during transport from the inlet to the outlet of the system.

11 Claims, 3 Drawing Figures

METHOD AND APPARATUS FOR PUMPING LARGE SOLID ARTICLES

This is a continuation of application Ser. No. 938,223, filed Aug. 30, 1978, now abandoned.

BACKGROUND OF THE INVENTION

The present invention relates to pumps and pertains particularly to method and apparatus for pumping large solid articles.

Rotary disc pumps have been known for a considerable length of time. Such pumps, however, have not gained widespread use because they have been unable in the past to complete effectively with positive displacement pumps and bladed impeller pumps for the pumping of fluids.

The rotary disc pumps typically employ a multiplicity of closely spaced flat plain discs rotating within the pump housing. The pumping effect is obtained by frictional and shear forces developed between the rotating discs and the fluid. It has always been considered necessary that the discs be closely spaced in order to be effective. The prior art is exemplified by the following prior art references:

U.S. Pat. No. 1,061,142, issued May 16, 1919 to No. Tesla.

U.S. Pat. No. 2,087,834, issued July 20, 1937 to Brown et al.

U.S. Pat. No. 3,487,784, issued Jan. 6, 1970 to Rafferty et al.

U.S. Pat. No. 3,644,051, issued Feb. 22, 1972 to Schapiro.

U.S. Pat. No. 4,025,225, issued May 24, 1977 to Durant.

Other patents of interest include British Specification No. 179,043, dated May 4, 1922 to N. Tesla, and French Pat. Specification No. 866,706, issued May 31, 1941 to Girodin.

These pumps are all based on the theory that friction of the fluid on the surface of the plates of the rotor during rotation of the rotor develops centrifugal force, propelling the fluid outward toward the periphery of the plates. These, however, recognize the necessity for maintaining a fairly close spacing between the adjacent discs. The Rafferty patent, cited above, U.S. Pat. No. 3,487,784, suggests the use of a special disc-type pump for pumping blood. It also recognizes that for pumping blood, in order to avoid high forces on the blood, the spacing between the discs should be not less than ¼ of an inch. He does not, however, recognize the ability of the pump to function with a greater spacing or to pump solid articles.

The pumping of coal slurries and similar materials has been carried out in the past with bladed impeller type pumps. Such pumps, however, under these conditions are subjected to a very high wear rate and therefore have a very short life. They are also subject to frequent stoppage due to plugging.

The applicant has discovered the ability of the disc pump to function with a greater spacing between the discs. He has also discovered that such pumps can be utilized for pumping of fragile articles. This has subsequently led to the discovery that the pump can also handle large solid articles in a fluid medium so long as the articles can be maintained suspended within the medium. The applicant has demonstrated the pumping of solid articles, such as marbles and gravel, for example. These have been pumped at heights of 15 feet above the pump outlet with no apparent damage to the pump or to the article. Similarly, live fish and other articles have also been pumped.

It is therefore desirable that a pump be available which is capable of effectively conveying large solid articles in a fluid medium at a reasonable pressure head for a reasonable distance.

SUMMARY AND OBJECTS OF THE INVENTION

It is accordingly the primary object of the present invention to overcome the above problems of the prior art by providing a pump capable of pumping solid articles in a fluid medium.

Another object of the invention is to provide an effective pump for quickly and conveniently moving large solid articles in a fluid medium without damage to the articles or the pump.

In accordance with the primary aspect of the present invention, a pump is provided for the moving of large articles in a fluid medium, with the pump comprising a plurality of plain discs rotatably mounted within a chamber and pump housing and provided with an unobstructed passage between the inlet and outlet of the housing. The fluid is pumped through the pump by means of friction and/or shear forces and applied thereto by means of the impeller, with articles being suspended in and carried along with the fluid without impact with portions of the pump assembly.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
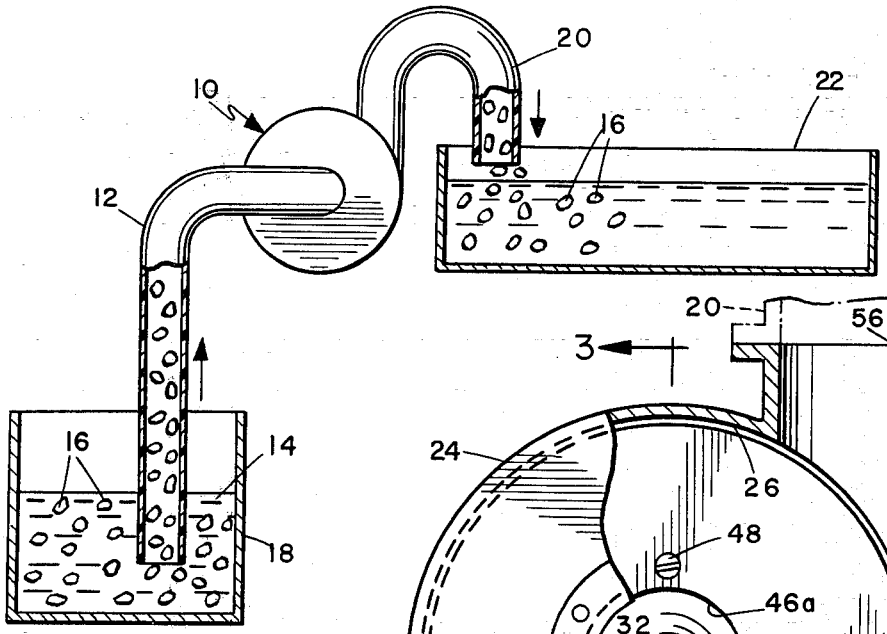
FIG. 1 is a diagram of a typical use of the pump for moving large articles or pieces of material.

Turning to the drawings, particularly FIG. 1, there is illustrated a pump designated by the numeral 10 having an inlet conduit 12 pumping a liquid such as water 14 and solid articles 16 from a tank by way of an outlet conduit 20 to a second tank 22. The solid article 16 can be of any substantial size and can be pumped so long as suspended in the water or other fluid and the pump passage is sufficiently large. These articles or particles 16 can be any article and can be substantially any size. The articles can be fruits and vegetables, such as apples, oranges, grapes, cherries, tomatoes, melons, potatoes, turnips, cucumbers, and the like. Other vegetables, such as leafy vegetables, can also be transported. These articles can also be hard solid articles such as marbles, rock, glass, coal slurry, gravel and other similar particles.

The primary key feature of the present invention is the use of combination of closely spaced pairs of discs in combination with widely spaced discs. In this combination, the closely spaced discs provide for an increased pressure head, while the larger spaces provide for the passage of articles or particles therethrough.

Figure 2:
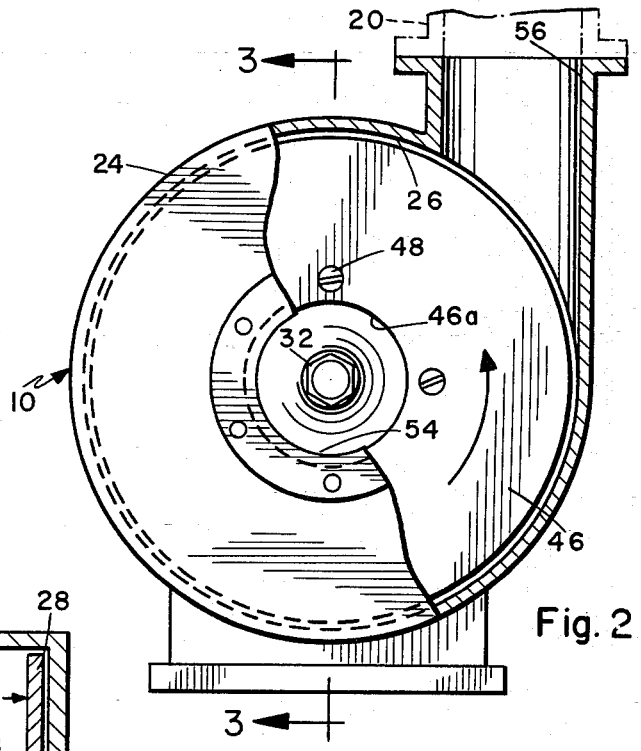
FIG. 2 is a front elevational view of the pump with a portion cut away.
Figure 3:
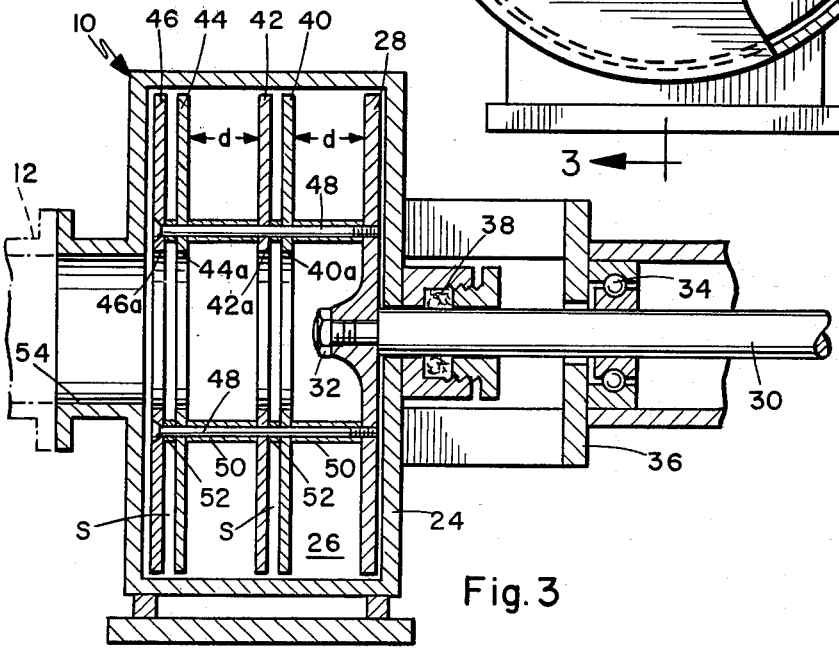
FIG. 3 is a sectional view taken on line 3—3 of FIG. 2.

Turning to FIG. 2, the pump 10 includes a housing 24 of a substantially cylindrical configuration having a substantially cylindrical chamber therein designated by the numeral 26. The rotor, as best seen in FIG. 3, comprises a drive disc 28 mounted on a drive shaft 30 by suitable means such as a nut 32. The drive shaft is mounted by a suitable bearings at 34 in a bearing support bracket 36 and is sealed by suitable seal means 38. The rotor comprises the drive disc 28 and any number of other discs disposed in pairs, such as pairs 40 and 42, closely spaced together a distance d from the drive disc 28. Similarly, a second pair of discs 44 and 46 may be similarly spaced a distance d from the first pair of discs 40 and 42.

The pairs of discs are spaced a distance S. This spacing S between the discs or pairs of discs is preferably adjusted to provide the necessary head or increased head as needed in the system. This spacing would depend on the size or outer diameter of the discs and the head which one desires. For example, it could vary from ten thousandths of an inch (0.0010) up to in excess of one and one half ($1\frac{1}{2}$) inch. The spacing of the discs at the outer edge thereof from the housing, in other words, the spacing of the periphery of the disc, from the inner wall of the housing has been found to be critical only insofar as it relates to the size of the particles being pumped. The spacing should be sufficiently small to prevent the passage of articles between the outer periphery of the discs and the inside of the wall. The outer disc 46 is also preferably fairly closely spaced from the wall of the housing. The discs are connected together and to the drive disc 28 by means of a plurality of elongated bolts 48 extending through each disc with spacer sleeves 50 having length d and spacer sleeves 52 having a length S. The spacing d would be, in most cases, related to the size or diameter of the inlet 54 and the maximum size article to be pumped.

Pumps have been tested by applicant having the space d up to 10 inches. Much larger spacings are possible along with larger diameter for the discs. When large spacings d are used for the pumping or handling of large articles, it is also desirable to have pairs of discs spaced distance S apart to increase the pressure head. However, such construction is not always necessary, but of course depends on the pressure head required.

One pump which has been undergoing testing for the pumping of small fish, such as anchovies, has a spacing d of $4\frac{1}{2}$ inches on a 30 inch diameter disc capable of lifting the fish in a stream or flow of water a height of 90 feet with a capacity of 5000 gallons per minute at 900 rpm's. Fish have been pumped a distance of two thousand (2000) feet through a 16 inch pipe with a 90 feet lift.

In the construction of the pump, the discs are each constructed to have an opening in the center thereof of a diameter which should be at least as large as the opening or inlet 54 of the pump. These inlet diameters 40*a*, 42*a*, 44*a* and 46*a* will be larger than the size of the articles to be pumped, and preferably larger than the inlet diameter. This will insure that articles which go into the pump will pass through the inner diameters of the disc. Preferably, the distance d between the discs will also have a specific relationship to the articles to be pumped which must also have a relationship to the inlet 54 on the pump. In this way, there is less likelihood of the pump jamming.

The outlet of the pump is preferably directly off the periphery of the outer diameter of the housing, as shown in FIG. 2, and includes an outlet 56 of a suitable diameter to carry the articles. The outlet preferably extends tangentially of the outer diameter of the housing and rotor.

Pumps in accordance with the invention, and those in accordance with my co-pending application Ser. No. 166,186, continuation of Ser. No. 938,224 entitled "Method and Apparatus for Pumping Fragile Articles" filed concurrently herewith, have undergone numerous tests and have been found to out-perform conventional impeller pumps under certain circumstances. For example, a pump has been undergoing tests for the pumping of glass particles of all different sizes and shapes in a water into a de-watering tank for recovering the spillage, etc., from a glass factory. The disc spacings in this pump are $\frac{3}{8}$ of an inch and the pump has undergone extensive tests without noticeable wear. This handling of these articles would not be possible with a bladed impeller pump, which would impact the glass particles with a resulting rapid wear and deterioration in the impeller.

A similar pump having a spacing of approximately $1\frac{1}{2}$ inches between discs of approximately 12 inches in diameter is undergoing tests for pumping raw sewage having the usual debris that accumulates in sewage. Such pump performs very well without the stoppage that normally occurs with a bladed impeller pump.

A similar pump with a disc spacing of approximately $1\frac{1}{4}$ inches on 12 inch diameter discs is undergoing tests in pumping coal slurry. This pump has performed very well and has not been subjected to the stoppage problems that normally occur with bladed impeller type pumps. The stoppage and rapid wear of the impeller and casing has been a major problem with the use of bladed impeller type pumps in the pumping of coal slurry.

A pump for pumping grout utilizing a $1\frac{1}{4}$ inch spacing between discs of a 14 inch diameter has been undergoing tests and has been found to be satisfactory for pumpings of slurries over short distances. A problem has been found to arise where different densities of materials are pumped, resulting in stoppage of the lines a distance downstream of the pump.

Thus, the pump of the present invention have been found to be ideally suited for certain applications wherein solid particles are being pumped in a fluid medium.

While I have described my invention by means of specific embodiments, it is to be understood that numerous changes and modifications may be made therein without departing from the spirit and scope of the invention as defined in the appended claims.

Having described my invention, I now claim:

1. A pump for pumping solid articles of a predetermined size, said pump comprising:

a housing having walls defining a cylindrical impeller chamber, an inlet coaxial with and communicating with said chamber, and an outlet communicating with and extending outward with the outermost wall thereof at a tangent to the outer periphery of same chamber, a multiple disc impeller rotatably mounted coaxially within said impeller chamber in said housing and having at least a first pair of coaxially disposed flat smooth continuous surface discs closely spaced a first distance apart defining a first path and so disposed within said housing to permit free flow of fluid via said first path therebetween to said outlet and defining a second path for unobstructed passage of articles of a predetermined size greater than said first distance from said inlet past said discs via said second path to said outlet.

2. A pump for pumping solid articles of a predetermined size, said pump comprising:

a housing having walls defining an impeller chamber, an inlet coaxial with and communicating with said chamber, an outlet communicating with the outer periphery of said chamber, and a multiple disc impeller rotatably mounted within said impeller chamber in said housing and having at least a first pair of coaxially disposed flat smooth surface discs closely spaced a first distance apart and so disposed within said housing to permit unobstructed passage of articles of a predetermined size greater than said first distance from said inlet past said discs via a path other than therebetween to said outlet, wherein said pair of discs are adjacent said inlet and said pair of discs include an opening in the center thereof to provide passage for said articles of a predetermined size.

3. A pump for pumping solid articles of a predetermined size, said pump comprising:

a housing having walls defining an impeller chamber, an inlet coaxial with and communicating with said chamber, an outlet communicating with the outer periphery of said chamber, and a multiple disc impeller rotatably mounted within said impeller chamber in said housing and having at least a first pair of coaxially disposed flat smooth surface discs closely spaced a first distance apart and so disposed within said housing to permit unobstructed passage of articles of a predetermined size greater than said first distance from said inlet past said discs via a path other than therebetween to said outlet, wherein said impeller comprises a drive disc mounted on a drive shaft and defining a third disc spaced from said first pair of discs, and said third disc connected to and spaced further from the adjacent disc of said first pair of discs than said first distance thereby providing said path.

4. A method of transporting solid articles of a predetermined size from a first location to a second location, comprising the steps of:

selecting a rotary disc impeller pump having an inlet and an outlet, said impeller having pairs of closely spaced discs for increasing the pressure therein, and a spacing between at least a pair of discs sufficient to permit unobstructed passage of solid articles of a predetermined size, connecting said pump in conduit means extending between said first location and said second location, selecting solid articles of a predetermined size to be transported, introducing said articles into a liquid, and thereby forming a mixture, and introducing said mixture into the inlet thereof at said first location.

5. The method of claim 4, wherein the step of selecting said articles includes selecting said articles from the class consisting of fruits and vegetables.

6. The method of claim 4, wherein the step of selecting said articles includes selecting said articles from the class consisting of marbles, rock, coal particles, and glass particles.

7. A pump for pumping solid articles of a predetermined size, said pump comprising:

a housing having a substantially cylindrical impeller chamber, an inlet coaxial with and communicating with said chamber, an outlet communicating with the outer periphery of said chamber, and a multiple disc impeller rotatably mounted within said housing and having at least three discs, two of said discs spaced a first distance apart, sufficient to permit unobstructed passage of articles of a predetermined size from said inlet therebetween to said outlet, and a third disc spaced a second distance from one of said two discs, said second distance being less than said first distance and providing optimum impelling force on a fluid passing therebetween.

8. The pump of claim 7, wherein said first distance is at least one fourth of an inch and said second distance is between one ten thousandths and one quarter of an inch.

9. The pump of claim 7, wherein said second distance is greater than one and one-half inches.

10. The pump of claim 7, wherein said second distance is between one ten thousandths and one and one-half of an inch.

11. The pump of claim 10, wherein said third disc and the other of the first pair of discs include:

means defining a hold through the center thereof and defining an inner diameter thereof, and a plurality of bolts connecting said discs together closely adjacent the inner diameter thereof.

* * * * *